US007891495B2

(12) United States Patent
Nobles

(10) Patent No.: US 7,891,495 B2
(45) Date of Patent: Feb. 22, 2011

(54) BATTERY BAG

(75) Inventor: Barry Nobles, Churchville, NY (US)

(73) Assignee: Harris Corporation, Melbourne, FL (US)

( * ) Notice: Subject to any disclaimer, the term of this patent is extended or adjusted under 35 U.S.C. 154(b) by 421 days.

(21) Appl. No.: 12/115,630

(22) Filed: May 6, 2008

(65) Prior Publication Data

US 2009/0279810 A1 Nov. 12, 2009

(51) Int. Cl.
*B65D 73/02* (2006.01)

(52) U.S. Cl. ..... 206/703; 206/705; 206/320; 429/99; 429/100

(58) Field of Classification Search ..... 206/703, 206/705.32; 383/66; 429/99, 96, 97, 98, 429/100, 159
See application file for complete search history.

(56) References Cited

U.S. PATENT DOCUMENTS 4,099,656 A 7/1978 Neumann et al.
5,766,801 A * 6/1998 Inoue et al. ..... 429/99
2006/0040173 A1* 2/2006 Shimamura et al. ..... 429/99
2008/0182161 A1* 7/2008 Prange ..... 429/99

* cited by examiner

*Primary Examiner*—J. Gregory Pickett
*Assistant Examiner*—Andrew Perreault
(74) *Attorney, Agent, or Firm*—Fox Rothschild, LLP; Robert J. Sacco

(57) ABSTRACT

A battery bag assembly including an elongated watertight bag (WTB), a sealable access port (SAP), a battery tray (BT), a power feed-through (PFT), and an electric power conduit (EPC). SAP (402) has an elongated configuration extending along an elongated length of the WTB. BT (600) is disposed within the WTB so that its elongated configuration is aligned with the elongated length of the WTB. BT has electrical connector sockets (EPSs) mounted thereon for mating with oppositely sexed connectors provided on batteries. PFT (352) is disposed on a wall of the watertight bag. PFT is configured to provide a watertight seal for an electrical conductor passing from an interior of the watertight bag to an exterior of the watertight bag. EPC (360) is electrically connected for coupling electric power from the EPSs on the BT to a remote device.

17 Claims, 11 Drawing Sheets

BATTERY BAG

BACKGROUND OF THE INVENTION

1. Statement of the Technical Field

The invention concerns battery bags, and more particularly, battery bags for use with unattended remote devices deployed in all types of environments.

2. Description of the Related Art

Batteries are commonly used to power certain types of equipment installed in remote locations where no other power source is readily available. For example, batteries can be used to power military communications and surveillance equipment. In order to camouflage such batteries and protect them from the weather, it is known to store the batteries in a protective battery bag. Such battery bags are sometimes buried or partially submerged in water to reduce the likelihood that the batteries will be discovered.

A conventional battery bag is shown in FIGS. 1 and 2. The conventional battery bag 100 is comprised of a water-resistant material so as to protect batteries (not shown) from being exposed to water. The conventional battery bag 100 is also comprised of two opposing ends 102, 104. A first end 102 of the battery bag 100 includes an opening 152 for enabling the insertion of a retaining bag 170 (containing a set of batteries) into the battery bag 100. Notably, the set of batteries (not shown) are coupled together (e.g., taped together) prior to being inserted into the retaining bag 170. This battery coupling ensures that the batteries will fit in the retaining bag 170 and an inner compartment 112 of the conventional battery bag 100. The compartment 112 is sized and shaped to allow the retaining bag 170 (including the batteries) to snuggly fit within the battery bag 100.

The conventional battery bag 100 is also comprised of an upper section 156 with an aperture 106 for allowing an electric power conduit 108 to pass through the battery bag 100. It should be noted that the aperture 106 can have a bulkhead feed-through 158 disposed therein. The bulkhead feed-through 158 is configured for providing a water resistant seal around a electric power conduit 110 of an electric power conduit 108. The electric power conduit 108 is electrically connected to at least one battery (not shown) retained in the battery bag 100. A plug 112 disposed at an end of the electric power conduit 110 can be coupled to an unattended remote device (not shown). The unattended remote device can include, but is not limited to a sensor, a radio, and a transmitter.

The above described conventional battery bag assembly suffers from certain drawbacks. For example, if a battery (not shown) needs to be replaced, then the battery bag 100 must be completely unburied. This unburying process is time consuming and labor intensive.

Also, if a battery (not shown) needs to be replaced, then a battery replacement process is performed. The battery replacement process involves: removing a retaining bag 170 from the battery bag 100; removing the batteries (not shown) from the retaining bag 170; un-coupling (or un-tapping) the batteries (not shown); replacing the discharged batteries with charged batteries; coupling (or taping) the charged batteries together; connecting the batteries to the electric power conduit 108; inserting the charged batteries into the retaining bag 170; and inserting the retaining bag 170 into the battery bag 100. One can appreciate that this battery replacement process is time consuming and labor intensive.

SUMMARY OF THE INVENTION

This Summary is provided to comply with 37 C.F.R. § 1.73, requiring a summary of the invention briefly indicating the nature and substance of the invention. It is submitted with the understanding that it will not be used to interpret or limit the scope or meaning of the claims.

The present invention concerns battery bag assemblies. The battery bag assemblies comprise a watertight bag, a sealable access port, and a battery tray. The watertight bag has an elongated configuration. The watertight bag is formed of a flexible waterproof bag material. The sealable access port has an elongated configuration that extends along an elongated length of the watertight bag.

The battery tray is a rigid structure disposed within the watertight bag. The battery tray has an elongated configuration aligned with the elongated length of the battery bag. The battery tray comprises one or more electrical connector sockets mounted thereon. Each of the electrical connector sockets is configured to mate with an oppositely sexed connector provided on a battery. The battery tray can also have an alignment structure. The alignment structure is configured to align the batteries with the electrical connector sockets. A securing means can be provided to secure the batteries to the battery tray. The securing means can be a fabric webbing attached to the battery tray.

The battery bag assemblies also comprise a power feed-through and an electric power conduit. The power feed-through is disposed on a wall of the watertight bag. The power feed-through is configured to provide a watertight seal for an electrical conductor passing from an interior of the watertight bag to an exterior of the watertight bag. The electric power conduit is electrically connected for coupling electric power from the electrical connector sockets on the battery tray to an external device.

According to an aspect of the invention, the electric power conduit can extend through the power feed-through or to the power feed-through. If the electric power conduit extends through the power feed-through, then the power feed-through is configured to form a watertight seal around a periphery of the electric power conduit. If the electric power conduit extends to the power feed-through, then the power feed-through includes a watertight electrical bulkhead feed-through extending through the wall of the watertight bag.

According to another aspect of the invention, the battery bag assemblies further comprise a clip, an electronic circuit, and/or a securing member. The clip is configured to secure the fabric webbing of the securing means around a periphery of a battery positioned within the battery tray. The electronic circuit can be coupled to the electrical connector sockets. The electronic circuit can be configured to monitor a battery condition and/or prevent battery overload. The electronic circuit can be a printed wiring board secured to the battery tray. The securing member can be configured to secure a collapsible section of the watertight bag in a rolled configuration.

According to yet another aspect of the invention, the battery tray is disposed in a storage section of the watertight bag opposed from the sealable access port. The storage section can extend from the battery tray to a height approximately corresponding to a height of a battery to be secured in the battery tray. The sidewalls of the watertight bag can extend a predetermined distance above the height to define the collapsible section of the watertight bag.

BRIEF DESCRIPTION OF THE DRAWINGS

Embodiments will be described with reference to the following drawing figures, in which like numerals represent like items throughout the figures, and in which.

DETAILED DESCRIPTION OF THE PREFERRED EMBODIMENTS

The invention concerns battery bag assemblies configured for housing batteries. The invention will now be described more fully hereinafter with reference to accompanying drawings, in which illustrative embodiments of the invention are shown. This invention, may however, be embodied in many different forms and should not be construed as limited to the embodiments set forth herein.

Before describing the battery bag assemblies of the present invention, it will be helpful in understanding an exemplary environment in which the invention can be utilized. In this regard, it should be understood that the battery bag assemblies of the present invention can be utilized in a variety of different applications where electrical devices are deployed in an unattended and potentially wet environment. Such applications include, but are not limited to, military applications, diving applications, electrical applications, camping applications, hiking applications, and water sport applications.

Figure 3:
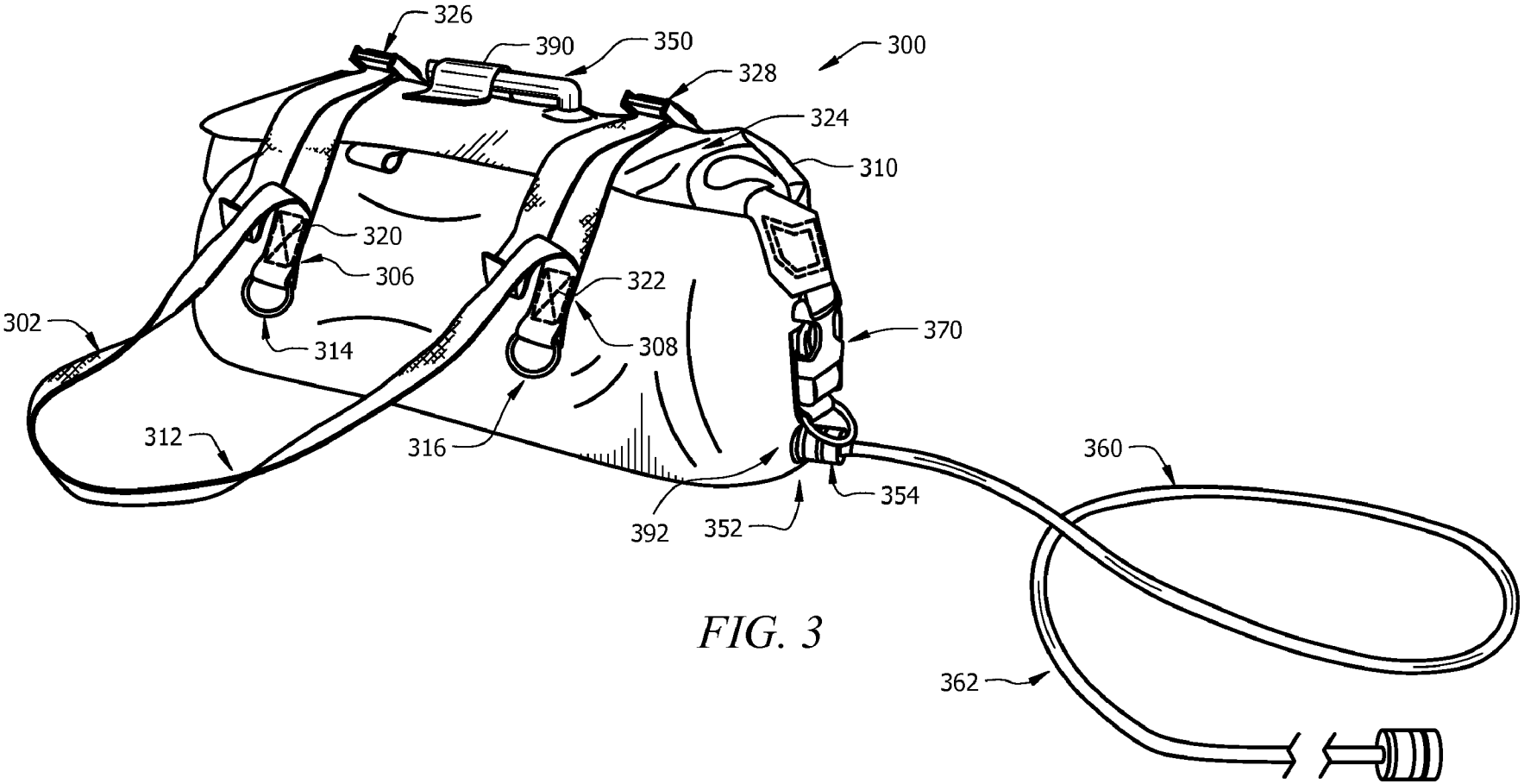
FIG. 3 is a perspective view of a battery bag assembly in a closed state that is useful for understanding the present invention.
Figure 4:
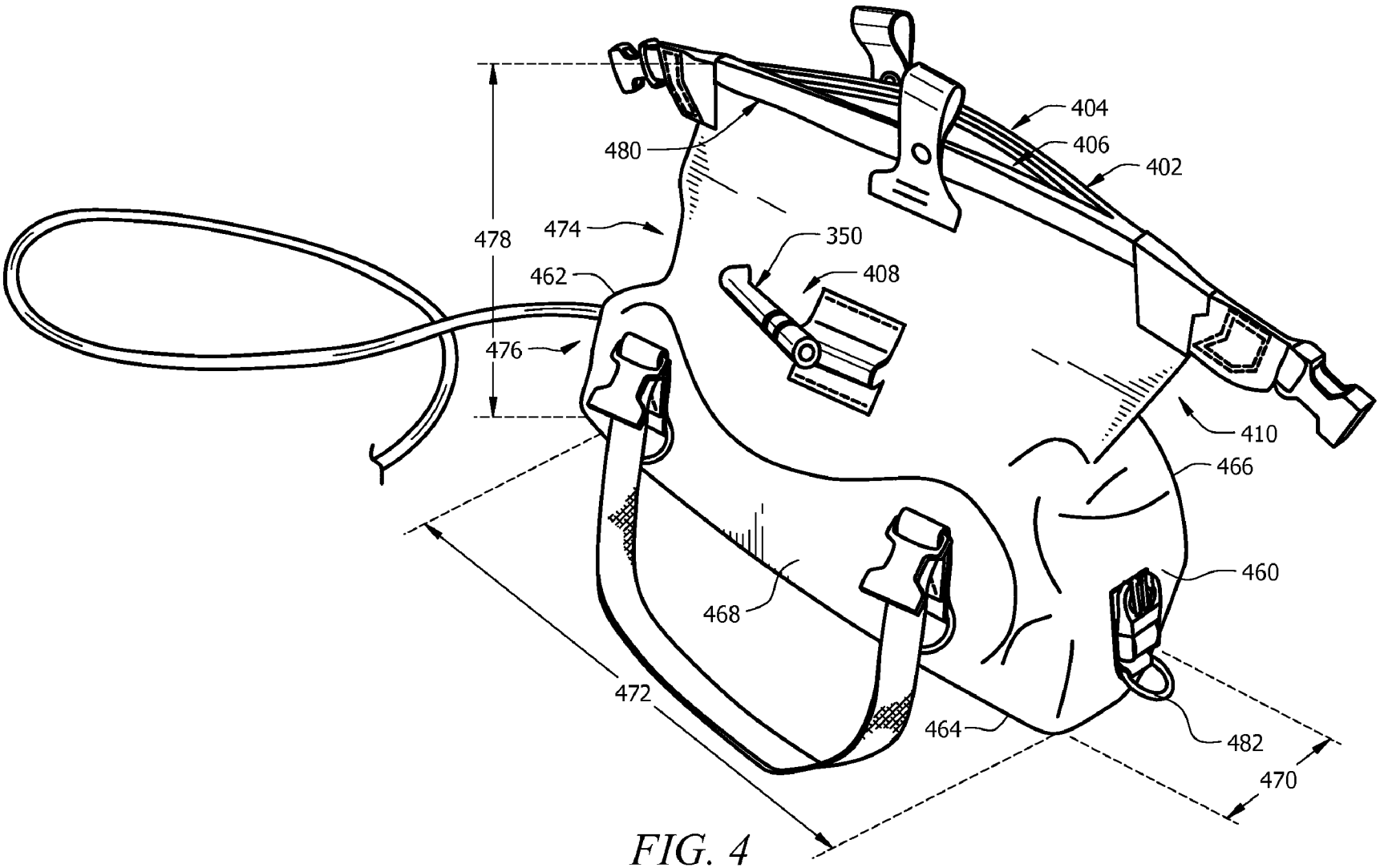
FIG. 4 is a perspective view of the battery bag assembly of FIG. 3 in an open state that is useful for understanding the present invention.

Referring now to FIGS. 3 and 4, there are provided perspective views of a battery bag assembly 300 that are useful for understanding the present invention. The battery bag assembly 300 is shown in FIG. 3 in its closed position. The battery bag assembly 300 is shown in FIG. 4 in its open position. As shown in FIGS. 3 and 4, the battery bag assembly 300 is comprised of a bag member 310. The bag member 310 is formed of a flexible water-resistant material to protect its contents (not shown) from exposure to water. The battery bag assembly 300 can also be comprised of an air-tight material, a rip-resistant material, and/or a non-reflective material. Such materials can include, but are not limited to, plastics, rubbers, and laminated materials.

According to an embodiment of the invention, the bag member 310 is a relatively inexpensive commercial off the shelf (COTS) bag. Such a COTS bag includes a WaterShed ZipDry® Bag available from WaterShed® of Ashville, N.C. Still, the invention is not limited in this regard. The bag member 310 can be any type of bag selected in accordance with a particular battery bag assembly 300 application.

As shown in FIG. 4, the bag member 310 is generally an elongated duffle style bag. In this regard, it should be understood that the bag member 310 is comprised of an elongated front panel 468, an elongated back panel 466, an elongated bottom panel 464, and side panels 460, 462. The front and back panels 468, 466 reside in generally parallel planes that are perpendicular to the planes in which the side panels 460, 462 reside. The bottom panel 646 resides in a plane which is generally transverse to the parallel planes in which the front and back panels reside 468, 466. The side panels 460, 462 have widths 470 that are less than the widths 472 of the elongated front and back panels 468, 466. However, the front, back, and side panels 468, 466, 460, 462 have the same or substantially similar heights 478.

The bag member 310 is also comprised of a collapsible section 474 and a storage section 476. The collapsible section 474 defines an upper or top portion of the bag member 310. The collapsible section 474 is configured to be collapsed or rolled so as to decrease the height of the bag member 310. The storage section 476 defines a lower or bottom portion of the bag member 310. The storage section 476 is configured to retain a battery tray (described below in relation to FIGS. 6-9) and a plurality of batteries (described below in relation to FIG. 6) in the bag member 310. A schematic illustration of a battery tray and batteries disposed in the storage section of the bag member 310 is provided in FIG. 10.

Referring again to FIGS. 3-4, the front, back, and side panels 468, 466, 460, 462 are joined together so as to form an elongated sealable access port 402 extending along an elongated length of said bag member 310. The elongated sealable access port 402 is formed on the collapsible section 474. The elongated sealable access port 402 is configured to facilitate a battery replacement process that is less time consuming and labor intensive as compared to a battery replacement process of conventional battery bag assemblies (such as the battery bag assembly shown in FIGS. 1-2). In this regard, it should be understood that the elongated sealable access port 402 enables the partial unburying of the battery bag assembly 300, i.e., only the collapsible section 474 of the battery bag assembly 300 needs to be unburied. The elongated sealable access port 402 also enables a removal of batteries from the battery bag assembly 300 that is easier than a removal of batteries from a conventional battery bag assembly (such as the battery bag assembly shown in FIGS. 1-2). Similarly, the elongated sealable access port 402 enables the insertion of batteries into the battery bag assembly 300 that is easier as compared to an insertion of batteries into a conventional battery bag assembly (such as the battery bag assembly shown in FIGS. 1-2). This result will be more easily understood as the description of the invention progresses.

Referring again to FIG. 4, the elongated sealable access port 402 is closeable by means of a sealing structure 404. The sealing structure 404 can be, but is not limited to, a snap seal structure (shown in FIG. 4) and a zipper (not shown). The sealing structure 404 can be coupled to an upper portion 410 of the bag member 310 by means of sewing, welding, or the like. If welding is employed, then the material of the sealing structure 404 may be partially melted so that it attaches to the material of the bag member 310. The seam or seal 480 formed from securing the sealing structure 404 to the bag member 310 is water-tight and/or air-tight. The elongated sealable access port 402 is sized and shaped to allow a plurality of batteries (not shown) to be easily inserted into the bag member 310 or removed from the bag member 310. According to one aspect of the invention, the elongated sealable access port 402 has a pre-determined size approximately corresponding to a length of a plurality of abutting batteries (not shown in FIG. 4).

As shown in FIGS. 3-4, the battery bag assembly 300 is comprised of carrying straps 302 disposed on the front and back panels 468, 466 of the bag member 310. The carrying straps 302 can be formed of a water-resistant material or a non-reflective water-resistant material. More particularly, the carrying straps 302 can be formed of a reflective or non-reflective web. The web can include, but is not limited to, a durable polyester or nylon braid. The carrying straps 302 have portions 306, 308 attached to the bag member 310 by sewing or the like. The seams 320, 322 formed from coupling the portions 306, 308 to the bag member 310 are water-tight and/or air-tight. The carrying straps 302 are formed into carrying loops 312. The carrying loops 312 provide a means for carrying the battery bag assembly 300 by hand.

The carrying straps 302 can have adjustable retaining structures 326, 328 disposed thereon. The adjustable retaining structures 326, 328 are configured for retaining the battery bag assembly 300 in its closed position. The adjustable retaining structures 326, 328 can include any retaining structure known in the art for use in retaining a bag in a closed position. For example, the adjustable retaining structures 326, 328 can include a pair of clips that securely clip together as shown in FIGS. 3-4.

Similarly, the battery bag assembly 300 can comprise retaining structures 370 disposed on the side panels 460, 462 of the bag member 310. The retaining structures 370 are configured for retaining the battery bag assembly 300 in its closed position. More particularly, the retaining structures 370 are configured for retaining the collapsible section 474 in a collapsed state (as shown in FIG. 3). The retaining structures 370 can include any retaining structures known in the art for use in retaining a bag in a closed position or a collapsible section of a bag in a collapsed state. For example, the retaining structures 370 can include a pair of clips that securely clip together as shown in FIGS. 3-4.

The battery bag assembly 300 is also comprised of securing structures 314, 316 disposed on the front and back panels 468, 466 of the bag member 360. The battery bag assembly 300 is further comprised of securing structures 482 disposed on the side panels 460, 462 of the bag member 360. The securing structures 314, 316, 482 can include, but are not limited to, rigid loops. The securing structures 314, 416, 482 provide a means for removably coupling the battery bag assembly 300 to a user, a knapsack, a rucksack, a backpack, a sports bag, a belt, a vehicle, or the like. As such, the battery bag assembly 300 overcomes certain carrying limitations of conventional battery bags (such as the battery bag 100 shown in FIGS. 1-2). In effect, a user is not encumbered by the battery bag assembly 300 since it can be carried in conjunction with other equipment.

The battery bag assembly 300 is further comprised of a purge valve 350 disposed on the front panel 468 of the bag member 310. Purge valves are well known to those having ordinary skill in the art, and therefore will not be described in detail herein. However, it should be understood that the purge valve 350 can be used for bleeding out excessive air from an internal compartment 406 of the battery bag assembly 300. The excessive air can be removed from the internal compartment 406 so that the battery bag assembly 300 is substantially devoid of buoyancy. The purge valve 350 can alternatively be used for inflating the battery bag assembly 300 so as to provide an enhanced buoyancy.

As shown in FIG. 4, the purge valve 350 is disposed at a location 408 on a front panel 468 of the battery bag assembly 300. The location 408 is advantageously selected to ensure that the purge valve 350 resides on a top surface 324 of a battery bag assembly 300 when the battery bag assembly 300 is in a fully closed position as shown in FIG. 3 (or when the collapsible section 474 is in its fully collapsed state as shown in FIG. 3). In effect, the purge valve 350 is readily accessible to a user in a variety of applications, such as in an application where the battery bag assembly 300 is partially buried in the ground. It should be noted that a retaining structure 390 can be provided for retaining the purge valve 350 is a retained position (as shown in FIG. 3) when the battery bag assembly 300 is in use.

As shown in FIGS. 3-4, the battery bag assembly 300 is comprised of a power feed-through 352 formed at a pre-selected location 392 on the side panel 462. The power feed-through 352 can be any suitable structure capable of providing a watertight seal for electrical conductors extending from an interior compartment of the battery bag assembly 300 to an exterior of the battery bag assembly. Two alternative arrangements are contemplated. In one embodiment, an electric power conduit is passed directly through a panel of the battery bag and a seal is formed around an exterior of the electric power conduit. The seal can be formed by a compression fitting, a sealing membrane, and/or flexible sealant material formed of silicone, polyurethane rubber, polymer material or the like. In a second arrangement, the power feed-through 352 can be implemented as a watertight electrical bulkhead feed-through 354. The watertight electrical bulkhead feed-through 354 can include sealing structure for preventing water intrusion into the interior of the batter bag assembly, while also providing electrical conductors that pass through the wall of the batter bag assembly 300. The electrical bulkhead feed-through can also provide at least one mating structure for permitting a mating connector disposed on an electrical conduit to be mated to the electrical bulkhead feed-through. Thus, the power feed-through allows an electric power conduit 360 to pass through a wall of the battery bag assembly 300 or to otherwise be electrically coupled to the battery bag assembly 300, while preventing intrusion of water into the interior of the battery bag assembly.

The location 392 of the power feed-through 352 is selected so that an electric power conduit 360 can pass through or be connected to the storage section 476 of the bag member 310. According to an embodiment of the invention, the location 392 is selected to be adjacent to a battery tray (described below in relation to FIGS. 6-9) that is fully inserted into an internal compartment 406 of the bag member 310. Still, the invention is not limited in this regard. The location 392 can be selected in accordance with a particular battery bag assembly 300 application.

It should be noted that the positioning of the power feed-through 352 on a side panel 462 as shown ensures that the elongated sealable access port 402 disposed on the top of the bag can remain unobstructed over an entire elongated length of a battery tray for easier access to each battery position on the tray. The importance of this feature will be more completely understood from the discussion below concerning a battery tray.

Referring again to FIGS. 3-4, the electric power conduit 360 can be a single continuous cable or two cable sections coupled together via electrical bulkhead feed-through 354. If the electric power conduit is a single cable, then the electric power conduit 360 can have a first end (not shown) coupled to a battery tray (described below in relation to FIGS. 6-9) retained within the bag member 310. The electric power conduit 360 can also have a second end 362 having a connector (not shown) disposed thereon. The connector (not shown) is configured to provide an electrical connection between the electric power conduit 360 and an unattended remote device (not shown). Alternatively, if the electric power conduit 360 comprises two (2) cable sections coupled together via an electrical bulkhead feed-through 354, then the first cable section provides an electrical connection between the sealing structure 354 and at least one battery disposed on a battery tray (described below in relation to FIGS. 6-9). The second cable section provides an electrical connection between the sealing structure 354 and an unattended electronic device (not shown).

In certain applications, the battery bag assembly 300 is buried in the ground while the unattended remote device (not shown) is deployed on the surface of the ground. In such a scenario, the battery bag assembly 300 only needs to be unburied only to the extent necessary to expose the elongated sealable access port 402 for purposes of replacing a discharged battery (not shown). In contrast, a battery replacement process of conventional battery bags (such as the battery bag 100 of FIGS. 1-2) requires the entire bag to be unearthed so that an opening on the end or side of the bag can be accessed. Of course, the conventional battery bag 100 could be buried in a vertical orientation so that its opening 152 can be accessed without unearthing the entire bag. However, it will be appreciated that such an arrangement would require digging a trench having considerably greater depth as compared to the battery bag assembly 300.

Figure 5:
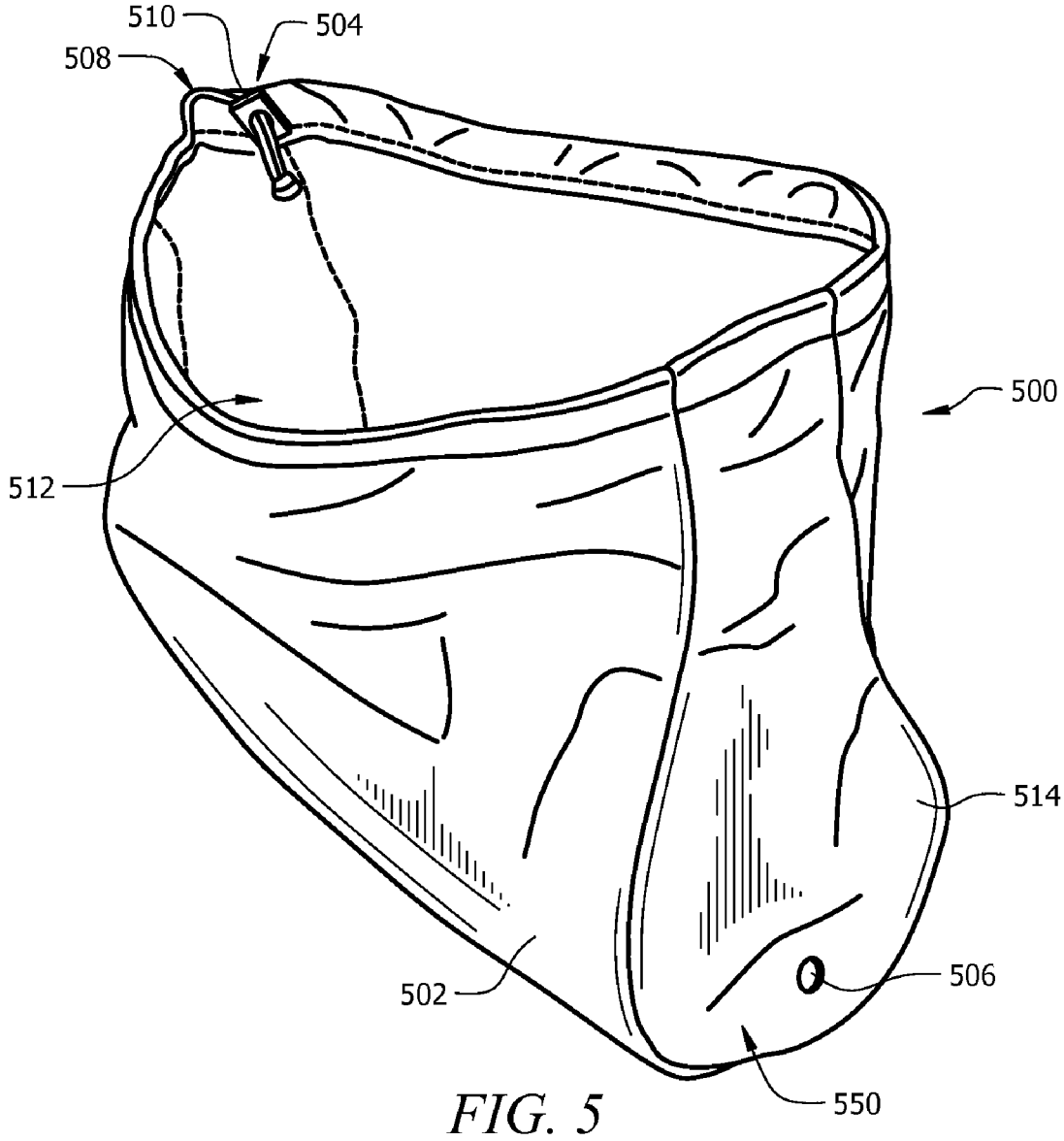
FIG. 5 is a perspective view of a rip-resistant bag that is useful for understanding the present invention.

It should be noted that the battery bag assembly 300 can be comprised of a removable rip-resistant bag 500, as shown in FIG. 5, which serves as a liner for batter bag assembly 300. The rip-resistant bag 500 is comprised of a bag member 502 and a sealing structure 504. The bag member 502 can be comprised of a rip-resistant material, such as canvas. The bag member 502 can be sized and shaped to retain a battery tray (described below in relation to FIGS. 6-9) having at least one battery (described below in relation to FIG. 6) disposed thereon. In this regard, it should be appreciated that the bag member 502 has an upper opening 512 sized and shaped for receiving a battery tray (described below in relation to FIGS. 6-9) and at least one battery (described below in relation to FIG. 6). The bag member 502 is also sized and shaped to fit within an internal compartment 406 of the bag member 310 (shown in FIG. 4).

The bag member 502 can comprise an aperture 506 formed in a side panel 514 of the bag member 502. The aperture 506 can be sized and shaped to allow the electric power conduit 360 to pass therethrough. In this regard, it should be understood that the aperture 506 is formed at a pre-selected location 550 on the side panel 514. The location 550 is selected so that a electric power conduit 360 can pass through a storage section 476 of the bag member 310 when the rip-resistant bag 500 is fully inserted into the bag member 310. According to one embodiment, the position of location 550 can be chosen so that it is generally aligned with power feed-through 354 when the bag member 502 is positioned within bag member 310.

The sealing structure 504 can be configured to facilitate the opening and closing of the rip-resistant bag 500. The sealing structure 504 can include any structure known in the art for opening and closing a bag. Such structures include, but are not limited to, snap seals, zippers, and ropes 508 with sliding members 510 disposed thereon (as shown in FIG. 5).

Figure 6:
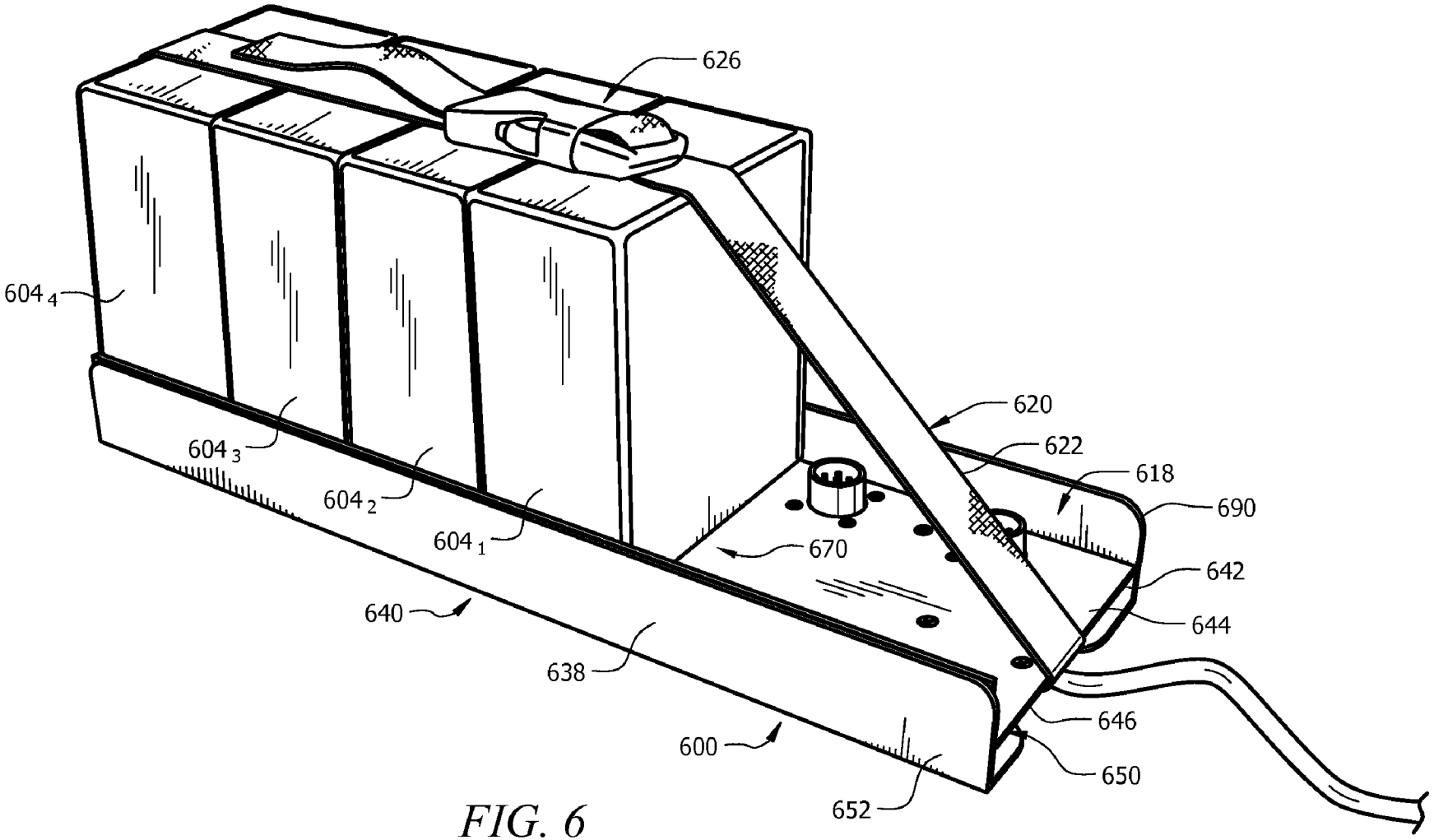
FIG. 6 is a perspective view of a battery tray having a plurality of batteries disposed thereon that is useful for understanding the present invention.

Referring now to FIG. 6, there is provided a perspective view of a battery tray 600 that is useful for understanding the present invention. The battery tray 600 is configured to be removably disposed in or secured within the bag member 310 and/or the rip-resistant bag 500 (if any). In this regard, it should be understood that the battery tray 600 can be a rigid structure having an elongated configuration. The elongated configuration can be selected so that it approximately corresponds with an elongated length of the bag member 310. As shown in FIG. 6, the battery tray 600 can be configured to retain the batteries $\mathbf{604}_1, \ldots, \mathbf{604}_4$ in a pre-defined arrangement. The pre-defined arrangement can include, but is not limited to, an arrangement as shown in FIG. 5 in which the batteries are snugly positioned adjacent to each other along the length of the battery tray 600 within a cavity 618. It should be noted that the battery tray 600 of FIG. 6 is configured to hold six (6) batteries. Still, the invention is not limited in this regard. The battery tray 600 can be designed to hold N batteries, where N is a value selected in accordance with a particular battery bag assembly 300 application.

According to another embodiment of the invention, the battery tray 600 can be dimensioned to accept a plurality of rechargeable Nickel Cadmium batteries having product number BB590/U available from Mathews Associates, Inc. of Sanford, Fla. Still, the invention is not limited in this regard. Each of the batteries $\mathbf{604}_1, \ldots, \mathbf{604}_4$ can be any type of rechargeable or non-rechargeable battery selected in accordance with a particular battery bag assembly 300 application.

Figure 7:
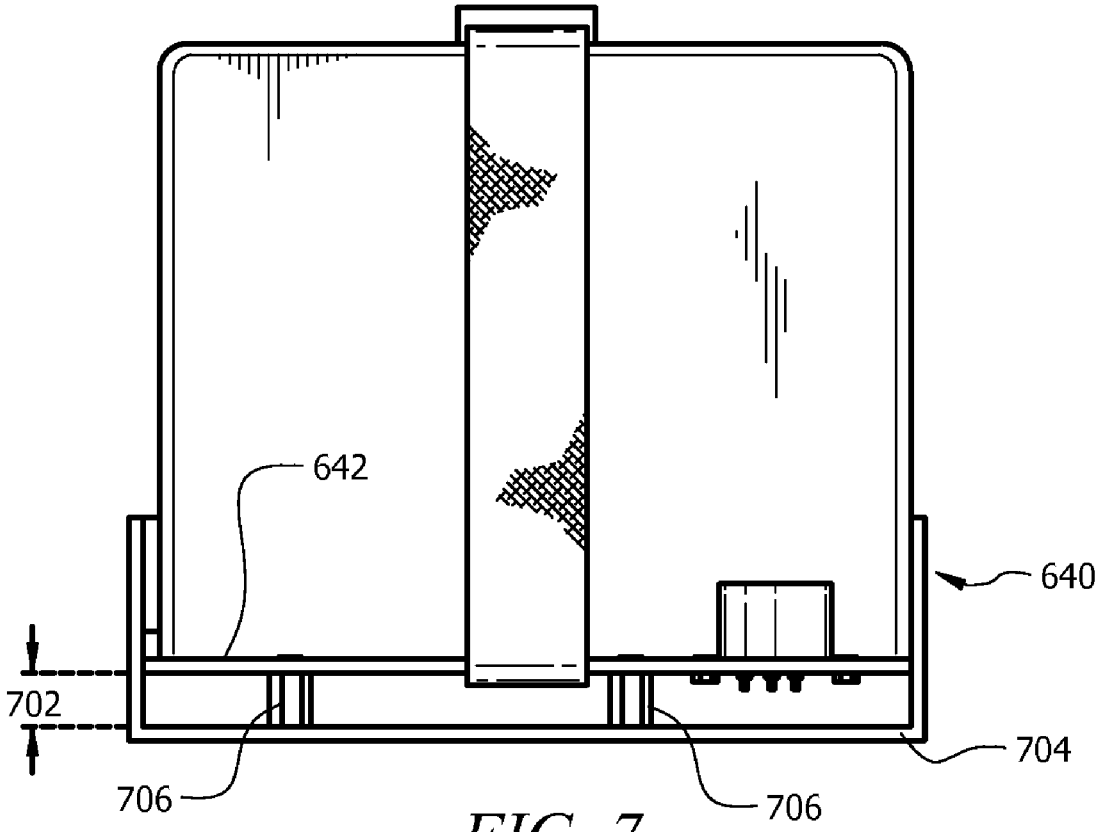
FIG. 7 is a side view of the battery tray shown in FIG. 6 that is useful for understanding the present invention.

As shown in FIG. 6, the battery tray 600 can be comprised of a chassis 640. The chassis 640 includes a support plate 642 formed of a rigid material. A side view of the battery tray 600 is provided in FIG. 7. As shown in FIG. 7, the support plate 642 can be coupled to the chassis 640 so as to reside a pre-determined distance 702 from a bottom panel 704 of the battery tray 600. In such a scenario, a plurality of spacers 706 can be placed between the bottom panel 704 of the battery tray 600 and the support plate 642.

It should be noted that the support plate 642 can be a rigid plate, a printed wiring board (PWB), or a rigid plate with a PWB disposed thereon. A top view of the support plate 642 having a PWB disposed thereon is provided in FIG. 8. A bottom view of the support plate 642 having a PWB disposed thereon is provided in FIG. 9. The support plate 642 can be formed of any suitably rigid material. Such suitably rigid materials include, but are not limited to, a metal material, a plastic material, and a composite material.

Figure 8:
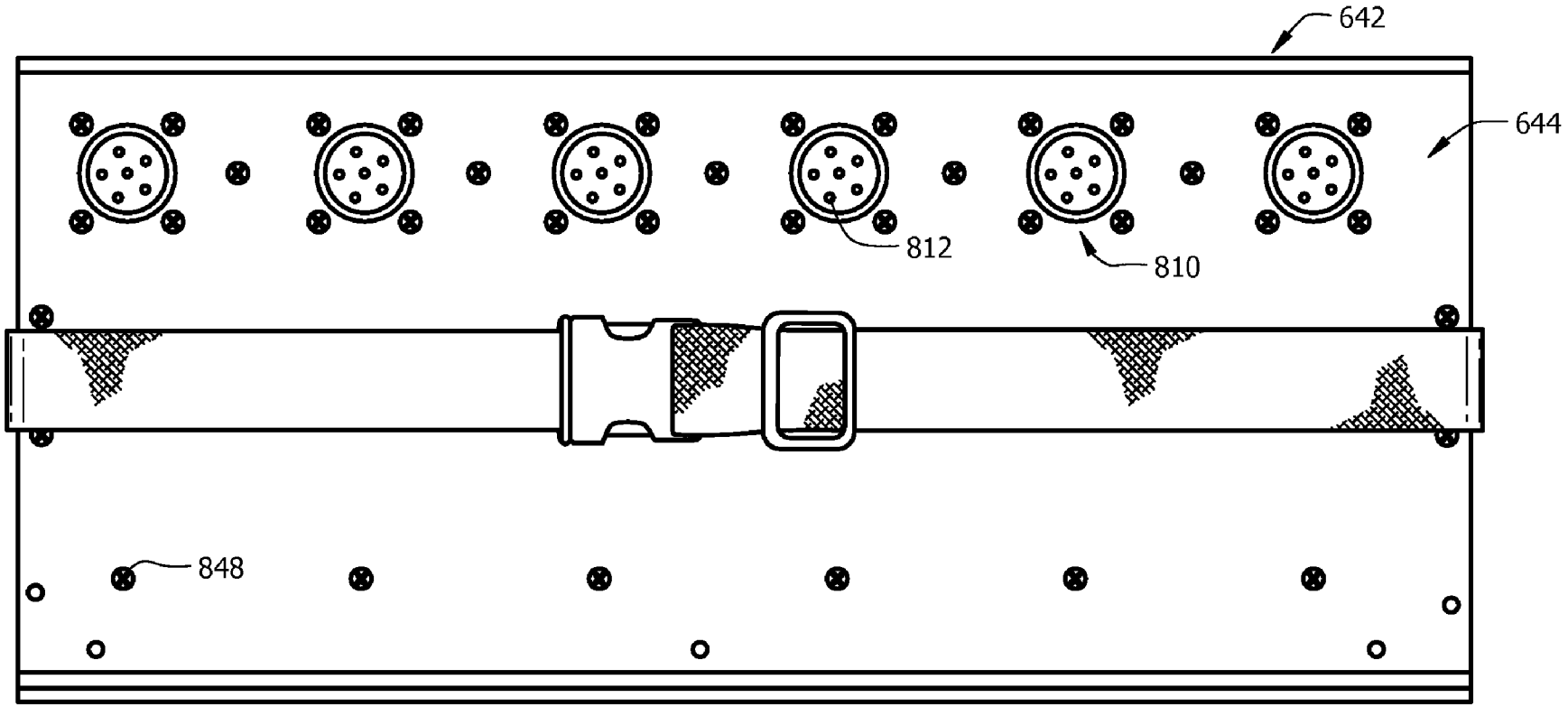
FIG. 8 is a top view of a support plate shown in FIG. 7 that is useful for understanding the present invention.
Figure 9:
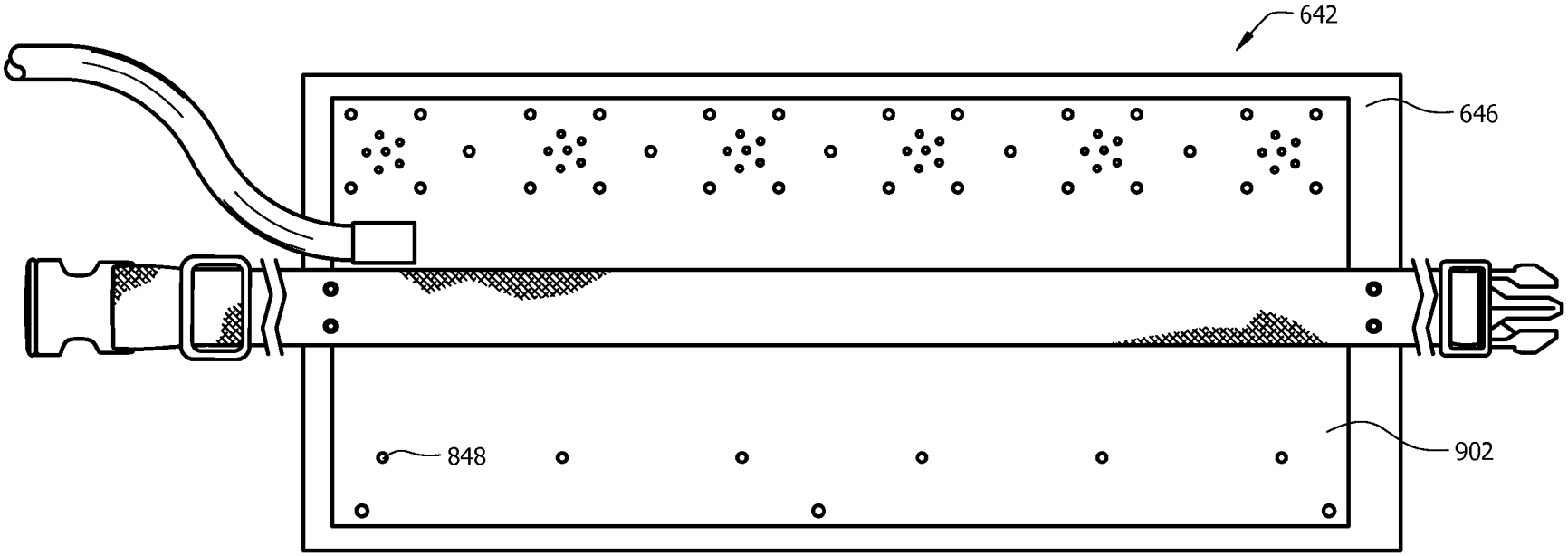
FIG. 9 is a bottom view of the support plate shown in FIGS. 7-8 that is useful for understanding the present invention.
Figure 10:
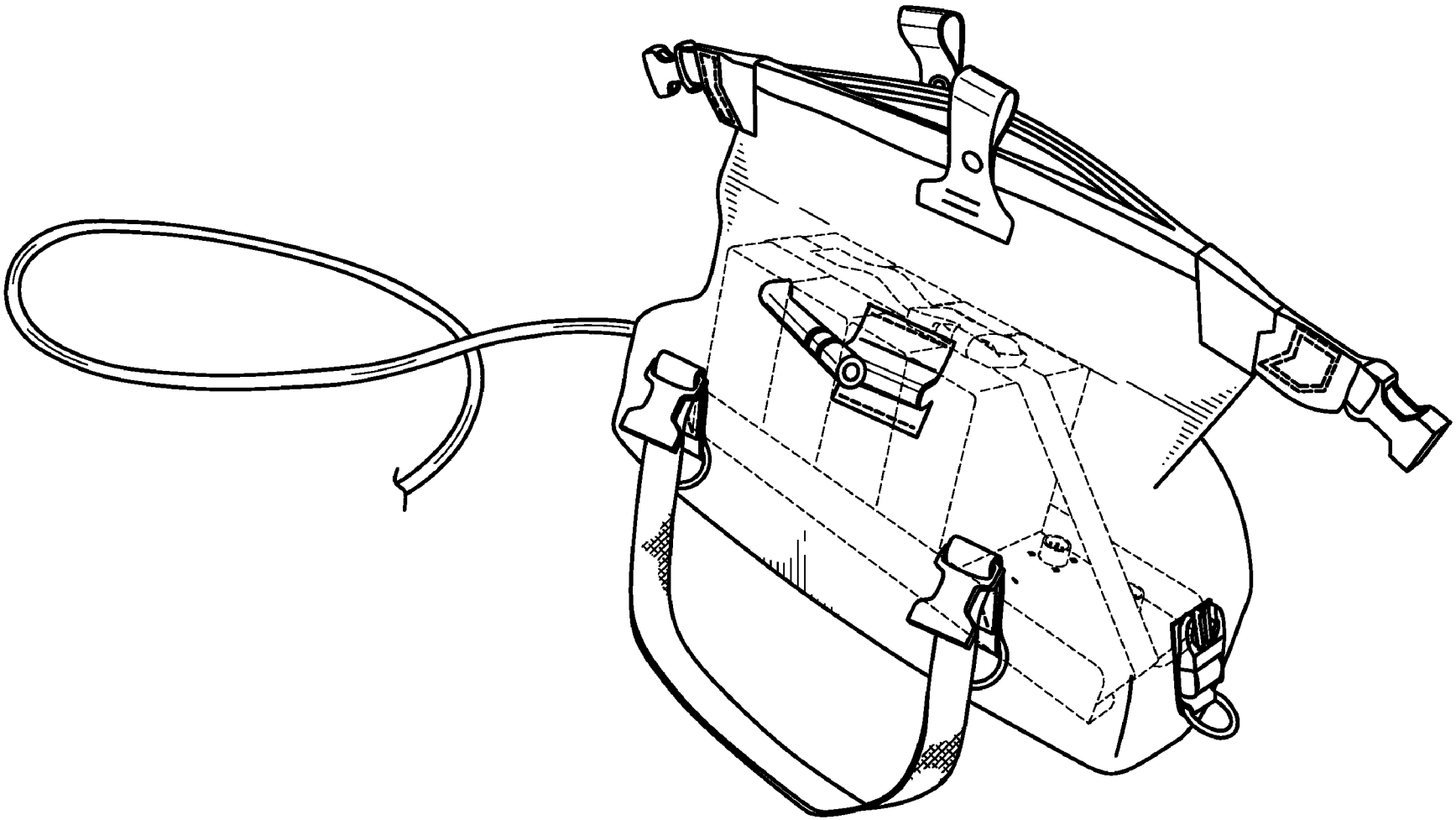
FIG. 10 is a schematic illustration of a tray and batteries disposed in the battery bag assembly of FIGS. 3-4.

As shown in FIGS. 6, 8, and 9, the support plate 642 is comprised of a top surface 644 and a bottom surface 646. A plurality of electrical connector sockets 810 are disposed at pre-defined locations on the support plate 642. The pre-defined locations are selected so that when the batteries $\mathbf{604}_1, \ldots, \mathbf{604}_4$ are positioned on the support plate 642 between alignment rails 690, the electrical connector sockets 810 will be guided toward oppositely sexed electrical connectors provided on the batteries $\mathbf{604}_1, \ldots, \mathbf{604}_4$. The electrical connector sockets 810 are attached to the electric power conduit 360 (described above in relation to FIGS. 3-4) via traces (not shown) and/or wires (not shown).

According to an embodiment of the invention, the electrical connector sockets 810 have exposed electrical terminals 812 that can be inserted snuggly into a corresponding mating connector of a battery $\mathbf{604}_1, \ldots, \mathbf{604}_4$. Each of the electrical connector sockets 810 can facilitate an electrical connection to a battery $\mathbf{604}_1, \ldots, \mathbf{604}_4$. Each of the electrical connector sockets 810 can also facilitate an electrical connection between an external device (not shown) and a battery $\mathbf{604}_1, \ldots, \mathbf{604}_4$ via the electric power conduit 360 (described above in relation to FIGS. 3-4). Still, the invention is not limited in this regard. The electrical connector sockets 810 can be any type of electrical connector sockets selected in accordance with a particular battery $\mathbf{604}_1, \ldots, \mathbf{604}_4$ application.

As shown in FIG. 9, the PWB 902 can be coupled to the support plate 642 so that it is adjacent to its bottom surface 646. The PWB 902 can be coupled to the support plate 642 via securing structures 848. The securing structures 848 can include, but are not limited to, screws. As should be understood, the PWB 902 can be comprised of conductive traces (not shown) and electronic components (not shown) to form functional circuits. Such functional circuits can include battery protection devices and battery monitoring devices.

Battery protection devices can include any circuit that is useful for preventing damage to the batteries or equipment to which the batteries are connected. According to one embodiment, the battery protection device can include unidirectional current valves (not shown). In such as scenario, the unidirectional current valves are connected in series with a set of batteries $\mathbf{604}_1, \ldots, \mathbf{604}_4$. The unidirectional current valves (not shown) are connected so as to allow current to flow from a battery $\mathbf{604}_1, \ldots, \mathbf{604}_4$ to an external device (not shown) but does not allow current flow in the reverse direction. Note that, absent suitable isolation, current provided by a first battery $\mathbf{604}_1, \ldots, \mathbf{604}_4$ can flow through an input line (not shown) toward a second battery $\mathbf{604}_1, \ldots, \mathbf{604}_4$ thereby potentially damaging the second battery $\mathbf{604}_1, \ldots, \mathbf{604}_4$. With the second battery $\mathbf{604}_1, \ldots, \mathbf{604}_4$ isolated by a unidirectional current valve (not shown), this current path is blocked. As such, any potential damage to the second battery $\mathbf{604}_1, \ldots, \mathbf{604}_4$ can be avoided. Still, the invention is not limited in this regard. The electronic components can include any types of components selected in accordance with a particular PWB 902 application.

It should be noted that the PWB 902 can be coupled to the support plate 642 so as to reside a pre-determined distance 702 from a bottom surface 646 of the support plate 642. In such a scenario, a plurality of spacers (not shown) can be placed between the bottom surface 646 of the support plate 642 and the PWB 902.

As shown in FIG. 6, the battery tray 600 can include an outer layer 638 disposed thereon. The outer layer 638 can comprise a rip-resistant material, such as canvas. The outer layer 638 can ensure that the battery tray 600 and/or batteries $\mathbf{604}_1, \ldots, \mathbf{604}_4$ do not chafe, puncture, and/or rip the bag member 310 of the battery bag assembly 300 during use. Still, the invention is not limited in this regard. For example, the battery tray 600 can be absent of the outer layer 638.

The battery tray 600 can also have a padding material 650 disposed on at least one side panel 652 of an alignment rail 690. The padding material 650 can be provided for ensuring that a battery $\mathbf{604}_1, \ldots, \mathbf{604}_4$ snuggly fits within the cavity 618 of the battery tray 600. The padding material can have an adhesive disposed thereon. The adhesive can be provided for ensuring that a particular end 670 of a battery $\mathbf{604}_1, \ldots, \mathbf{604}_4$ does not dislodge from the battery tray when an external force (such as a vibration force) is applied thereto. The invention is not limited in this regard. For example, the battery tray 600 can be absent of the padding material 650 and/or adhesive.

The battery tray 600 can also comprise a securing structure 620. The securing structure 620 is provided for retaining at least one battery $\mathbf{604}_1, \ldots, \mathbf{604}_4$ in the battery tray 600. According to an embodiment of the invention, the securing structure 620 is comprised of a strap 622 and a fastener 626. The strap 622 can be formed of a webbing. The strap 622 can extend around the periphery of batteries $\mathbf{604}_1, \ldots, \mathbf{604}_4$ positioned within the battery tray 600. The strap 622 can have fastener 626 disposed thereon. The fastener 626 can include any fastening structure known in the art, such as a clip including a male and female component (as shown in FIG. 6). The fastener 626 can secure the strap 622 around the periphery of batteries $\mathbf{604}_1, \ldots, \mathbf{604}_4$ positioned within the battery tray 600.

Figure 1:
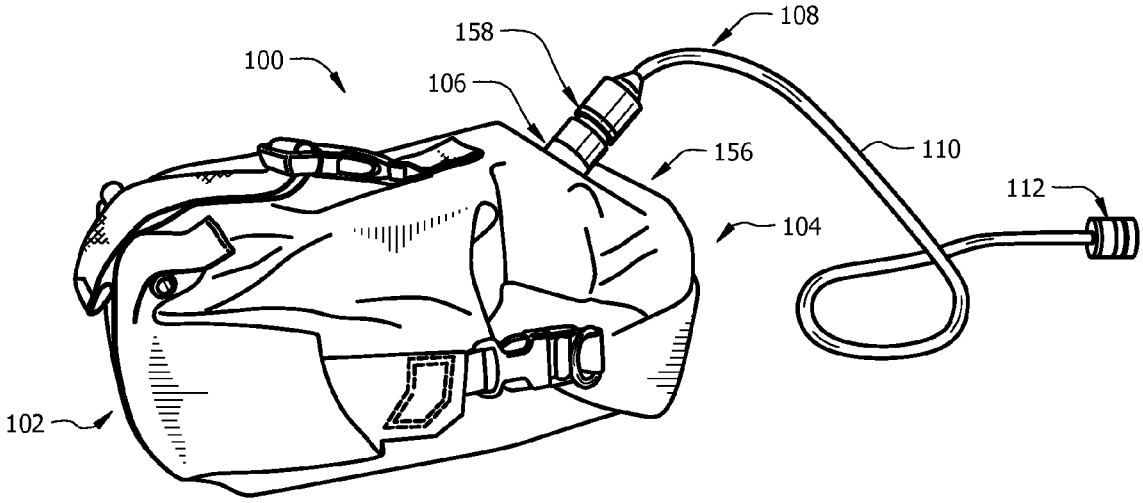
FIG. 1 (Prior Art)
FIG. 1 is a perspective view of a conventional battery bag assembly.
Figure 2:
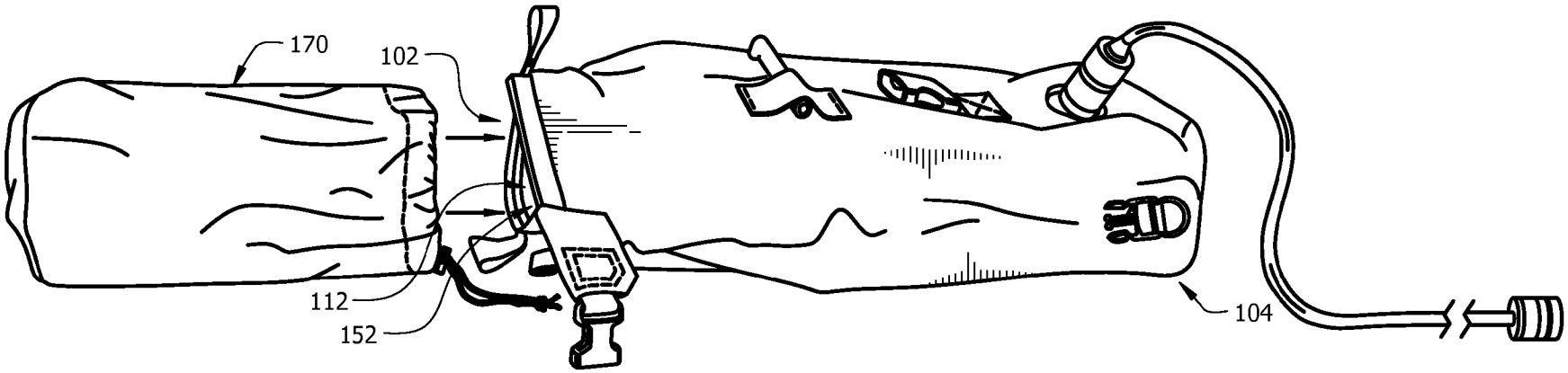
FIG. 2 (Prior Art)
FIG. 2 is a perspective view of a conventional battery bag assembly.

The battery tray 600 is provided to facilitate a battery replacement process that is less time consuming and labor intensive as compared to a battery replacement process of conventional battery bags (such as the battery bag 100 of FIGS. 1-2). In this regard, it should be understood that the battery tray 600 enables discharged battery $\mathbf{604}_1, \ldots \mathbf{604}_4$, to be conveniently accessed through the elongated sealable access port 402 of the battery bag assembly 300. This convenience is achieved by making all of the batteries easily accessible from the top of the bag, and eliminating the need to couple (i.e., tape) together the batteries $\mathbf{604}_1, \ldots \mathbf{604}_4$ prior to insertion into the battery bag assembly 300.

Figure 11:
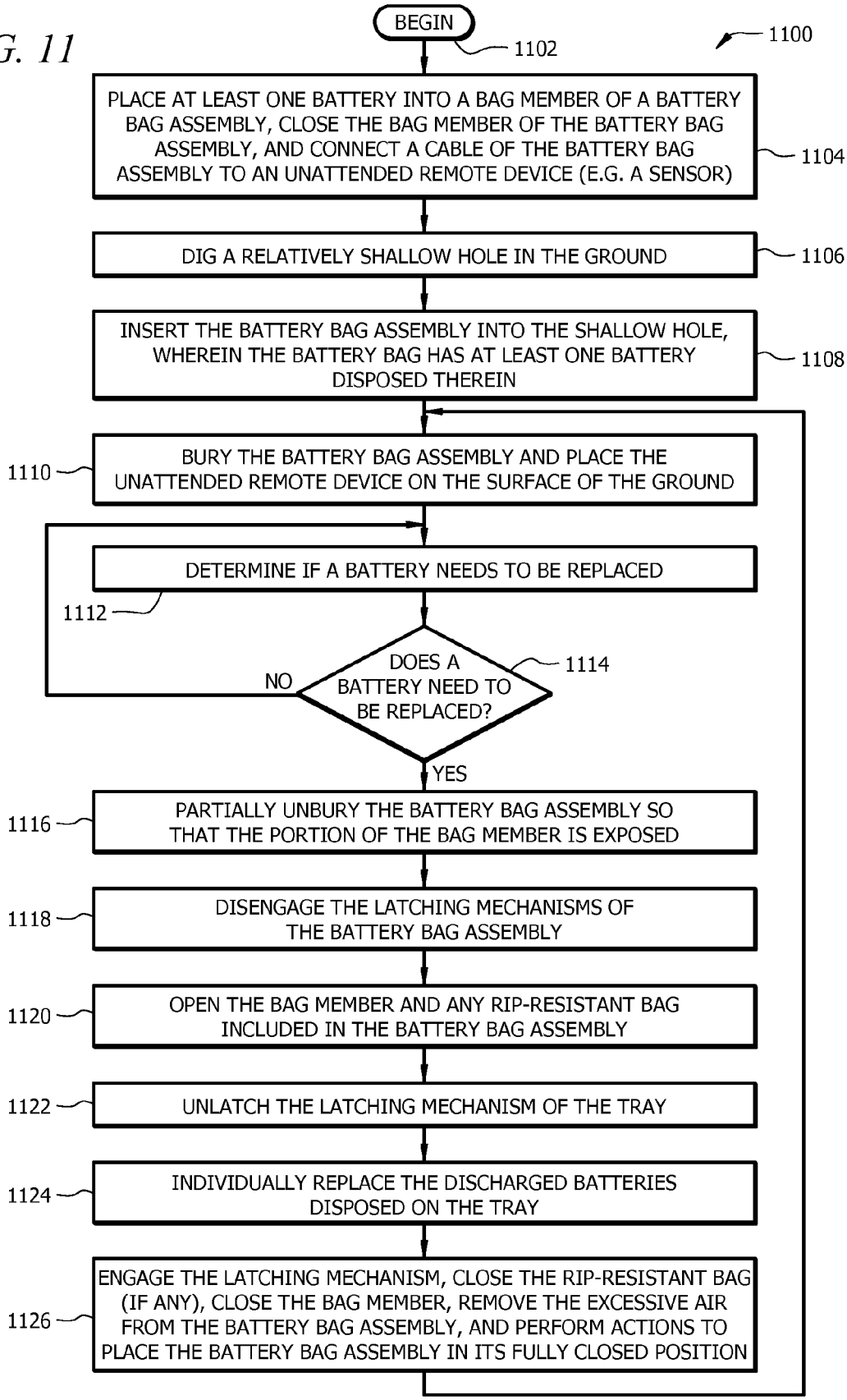
FIG. 11 is a flow diagram of an exemplary process for deploying the battery bag assembly of FIG. 3 and replacing a battery disposed in the deployed battery bag assembly that is useful for understanding the present invention.

The following FIG. 11 and accompanying text illustrate an exemplary process 1100 for deploying the battery bag assembly 300 and replacing a battery $\mathbf{604}_1, \ldots, \mathbf{604}_4$ disposed in the deployed battery bag assembly 300. It should be appreciated, however, that the process 1100 disclosed herein is provided for purposes of illustration only and that the present invention is not limited solely to the method shown.

As shown in FIG. 11, the process 1100 begins at step 1102 and continues with step 1104. In step 1004, at least one battery is placed into a bag member 310 of a battery bag assembly 300. Step 1104 can also involve closing the battery bag assembly 300 and connecting a electric power conduit 360 of the battery bag assembly 300 to an unattended remote device (e.g., a sensor or radio). After completing step 1104, step 1106 is performed where a hole is dug in the ground. Notably, this hole is shallower as compared to a hole required for burying a conventional battery bag assembly (such as the battery bag assembly shown in FIGS. 1-2). In steps 1108 and 1110, the battery bag assembly 300 is inserted into the shallow hole and buried therein. Step 1110 also involves placing the unattended remote device on the surface of the ground.

Subsequent to steps 1110, the process 1100 continues with step 1112. In step 1112, it is determined whether a battery $\mathbf{604}_1, \ldots, \mathbf{604}_4$ needs to be replaced. If it is determined that a battery $\mathbf{604}_1, \ldots, \mathbf{604}_4$ does not need to be replaced [1114: NO], then the process 1100 returns to step 1112. If it is determined that a battery $\mathbf{604}_1, \ldots, \mathbf{604}_4$ does need to be replaced [1114:YES], then the process 1100 continues with step 1116. In step 1116, the battery bag assembly 300 is partially unburied so that a top portion (or collapsible portion) of a bag member 310 is exposed.

Once the top portion (or collapsible portion) of the bag member 310 is exposed and accessible, step 1118 is performed. In step 1118, the latching structures 324, 326, and 370 of the battery bag assembly 300 are disengaged. Thereafter, step 1120 is performed where the bag member 310 is opened. Step 1120 can also involve opening a rip-resistant bag 500 included in the battery bag assembly 300 and disposed in the bag member 310. Step 1120 is performed to provide access to the batteries $\mathbf{604}_1, \ldots, \mathbf{604}_4$ disposed in the bag member 310 and/or rip-resistant bag 500. Once the batteries are made accessible, step 1122 is performed where the latching structure 626 of the battery tray 600 is unlatched.

Subsequently, the process 1100 continues with step 1124. In step 1124, the discharged batteries $\mathbf{604}_1, \ldots, \mathbf{604}_4$ are individually removed from the battery tray 600 and replaced with charged batteries. Thereafter, step 1126 is performed. In step 1126, the latching structure of the battery tray is engaged.

Step 1126 can also involve closing the rip-resistant bag 500 and bag member 310. Step 1126 can further involve removing excessive air from the battery bag assembly 300 and performing actions to place the battery bag assembly 300 in its fully closed position (as shown in FIG. 3). After completing step 1126, the process 1100 returns to step 1110.

One can appreciate that the process 1100 (i.e., steps 1104-1110) overcomes many of the drawbacks of a conventional battery bag deployment process. For example, the process 1100 of the battery bag assembly 300 is less labor intensive as compared to the deployment processes of conventional battery bag assemblies (such as that shown in FIG. 1). This less labor intensive deployment of the battery bag assembly 300 is at least partially achieved by the performance of step 1106 (i.e. a relatively shallow hole needs to be dug for burying the battery bag assembly 300).

Also, process 1100 (e.g., steps 1116-1126) is less time consuming and labor intensive as compared to the battery replacement processes of conventional battery bag assemblies (such as that shown in FIG. 1). This less time consuming and labor intensive battery replacement process is at least partially achieved by the performance of step 1124 (i.e., each discharged battery $\mathbf{604}_1, \ldots, \mathbf{604}_4$ is replaced individually).

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

The Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the following claims.

I claim:

1. A battery bag assembly, comprising:

a watertight bag having an elongated configuration and formed of a flexible waterproof bag material;

a sealable access port having an elongated configuration and extending along an elongated length of said watertight bag;

a battery tray formed of a rigid material and disposed within said watertight bag, said battery tray having an elongated configuration aligned with said elongated length of said watertight bag, and comprising at least two opposing sidewalls spaced a distance from each other, a support plate coupled to and disposed between said two opposing sidewalls for supporting a plurality of batteries, a circuit board securely fastened adjacent to a first surface of said support plate, and at least one electrical connector disposed on a second surface opposed from said first surface of said support plate, said electrical connector comprising at least one connector pin electrically connected to an electronic circuit disposed on said circuit board, and configured to mate with an oppositely sexed electrical connector provided on a battery of said plurality of batteries;

a securing means configured for securing said plurality of batteries to said battery tray;

a power feed-through disposed on a wall of said watertight bag, said power feed-through configured for providing a watertight seal for at least one electrical conductor passing from an interior of said watertight bag to an exterior of said watertight bag; and at least one electric power conduit electrically connected for coupling electric power from said at least one electrical connector on said battery tray to an external device, said at least one electric power conduit extending from said battery tray to at least to said power feed-through.

2. The battery bag assembly according to claim 1, wherein said electric power conduit extends through said power feed-through, and said power feed-through is configured to form a watertight seal around a periphery of said electric power conduit.

3. The battery bag assembly according to claim 1, wherein said power feed-through comprises a watertight electrical bulkhead feed-through extending through said wall of said watertight bag.

4. The battery bag assembly according to claim 1, wherein said securing means comprises a fabric webbing attached to said battery tray.

5. The battery bag assembly according to claim 4, further comprising at least one clip for securing said fabric webbing around a periphery of said plurality of batteries positioned within said battery tray.

6. The battery bag assembly according to claim 1, wherein said electronic circuit is configured for performing at least one function selected from the group consisting of monitoring a battery condition and preventing battery overload.

7. The battery bag assembly according to claim 1, wherein said battery tray is disposed in a storage section opposed from said sealable access port, said storage section extending from said battery tray to a height approximately corresponding to a height of a battery to be secured in said battery tray, and wherein a plurality of sidewalls comprising said watertight bag extend a predetermined distance above said height to define a collapsible section of said watertight bag.

8. The battery bag assembly according to claim 7, further comprising one or more securing members configured for securing said collapsible section of said watertight bag in a rolled configuration.

9. A battery bag assembly, comprising:

a watertight bag having an elongated configuration and formed of a flexible waterproof bag material;

a battery tray formed of a rigid material and disposed within said watertight bag, said battery tray having an elongated configuration aligned with an elongated length of said watertight bag, and comprising at least two opposing sidewalls spaced a distance from each other, a support plate coupled to and disposed between said two opposing sidewalls for supporting a plurality of batteries, a circuit board securely fastened adjacent to a first surface of said support plate, and at least one electrical connector disposed on a second surface opposed from said first surface of said support plate, said electrical connector comprising at least one connector pin electrically connected to an electronic circuit disposed on said circuit board, and configured for mating with an oppositely sexed electrical connector provided on a battery of said plurality of batteries;

a power feed-through disposed on a wall of said watertight bag, said power feed-through configured for providing a watertight seal for at least one electrical conductor passing from an interior of said watertight bag to an exterior of said watertight bag;

at least one electric power conduit electrically connected for coupling electric power from said at least one electrical connector socket on said battery tray to an external device, said at least one electric power conduit extending from said battery tray to at least to said power feed-through.

10. The battery bag assembly according to claim 9, wherein said electric power conduit extends through said power feed-through, and said power feed-through is configured to form a watertight seal around a periphery of said at least one electric power conduit.

11. The battery bag assembly according to claim 9, wherein said power feed-through comprises a watertight electrical bulkhead feed-through extending through said wall of said watertight bag.

12. The battery bag assembly according to claim 9, further comprising a securing means configured for securing said plurality of batteries to said battery tray.

13. The battery bag assembly according to claim 12, further comprising at least one clip for securing said securing means around a periphery of said plurality of batteries positioned within said battery tray.

14. The battery bag assembly according to claim 9, wherein said electronic circuit is configured for performing at least one function selected from the group consisting of monitoring a battery condition and preventing battery overload.

15. The battery bag assembly according to claim 9, wherein said battery tray is disposed in a storage section opposed from said sealable access port, said storage section extending from said battery tray to a height approximately corresponding to a height of a battery to be secured in said battery tray, and wherein a plurality of sidewalls comprising said watertight bag extend a predetermined distance above said height to define a collapsible section of said watertight bag.

16. The battery bag assembly according to claim 15, further comprising one or more securing members configured for securing said collapsible section of said watertight bag in a rolled configuration.

17. A battery bag assembly, comprising:

a watertight bag having an elongated configuration and formed of a flexible waterproof bag material;

a battery tray formed of a rigid material and disposed within said watertight bag, said battery tray having an elongated configuration aligned with an elongated length of said watertight bag, and comprising at least two opposing sidewalls spaced a distance from each other, a support plate coupled to and disposed between said two opposing sidewalls for supporting a plurality of batteries, a circuit board securely fastened adjacent to a first surface of said support plate, and at least one electrical connector disposed on a second surface opposed from said first surface of said support plate, said electrical connector comprising at least one connector pin electrically connected to an electronic circuit disposed on said circuit board, and configured for mating with an oppositely sexed electrical connector provided on a battery of said plurality of batteries; and at least one electric power conduit electrically connected for coupling electric power from said a least one electrical connector socket on said battery tray to an external device.

* * * * *